US005467505A

United States Patent [19]

Graf

[11] Patent Number: 5,467,505

[45] Date of Patent: Nov. 21, 1995

[54] CARD CLOTHING FOR A CARDING MACHINE

[75] Inventor: Ralph Graf, Freienbach, Switzerland

[73] Assignee: Graf + Cie AG Kratzen- Und Maschinenfabrik, Rapperswil, Switzerland

[21] Appl. No.: 286,474

[22] Filed: Aug. 4, 1994

[30] Foreign Application Priority Data

Aug. 4, 1993 [DE] Germany ..... 43 26 203.1

[51] Int. Cl.[6] ..... D01G 15/24; D01G 15/28; D01G 15/92

[52] U.S. Cl. ..... 19/114; 19/113

[58] Field of Search ..... 19/113, 114, 115, 19/105, 98

[56] References Cited

U.S. PATENT DOCUMENTS

| | | | |
|---|---|---|---|
| 693,817 | 2/1902 | Mills et al. | 19/113 |
| 1,709,038 | 4/1929 | Platt | 19/114 |
| 4,221,023 | 9/1980 | Henderson | 19/113 |
| 4,528,724 | 7/1985 | Bisquolm | 19/113 |
| 4,825,511 | 5/1989 | Stewart . | |
| 4,974,295 | 12/1990 | Demuth et al. | 19/113 |
| 5,142,742 | 9/1992 | Erni et al. | 19/113 |

FOREIGN PATENT DOCUMENTS

| | | |
|---|---|---|
| 138778 | 4/1985 | European Pat. Off. . |
| 336222 | 10/1989 | European Pat. Off. . |
| 2128620 | 12/1972 | Germany . |
| 860417 | 2/1961 | United Kingdom . |

*Primary Examiner*—John J. Calvert
*Attorney, Agent, or Firm*—Herbert Dubno; Andrew Wilford

[57] ABSTRACT

A card clothing has an array of parallel elongated strips each having an inwardly directed and longitudinally extending foot part, a multiplicity of hooks extending outward from the foot part, and a pair of ends. A pair of longitudinally spaced support elements wholly out of direct contact with each other is provided, one end of each of the strips being seated in one of the support elements and the other end of each of the strips being seated in the other support element. The support elements are formed to fit with support structure of the carding machine.

6 Claims, 1 Drawing Sheet

CARD CLOTHING FOR A CARDING MACHINE

FIELD OF THE INVENTION

The present invention relates to a carding machine. More particularly this invention concerns a card clothing for such a machine.

BACKGROUND OF THE INVENTION

A carding machine generally has a rotatable drum whose outer surface is provided with a card clothing in turn having a dense array of teeth or little hooks. The machine also has several covers provided with linings directed radially inward at the drum and also provided with similar card clothings. The covers are arranged about a portion of the periphery of the drum so that the outer card clothings on the covers of the housing interact with the inner card clothings on the drum outer surface.

When the carding machine is in use fibers are drawn from a region of the drum where there is no cover. The fibers are passed over the little hooks on the cover of the carding machine. As this happens the card clothings mounted on the covers engage into the fibrous material so that together the drum and the cover act on the fibers to work the fiber material and orient the fibers. To this end the covers can be moved along a portion of the periphery of the drum against the rotation direction of the drum. Since only the relative speed is important for the interaction of the drum and the cover. It is also possible to use a fixed-cover system where only the drum moves and the covers are fixed in position.

In order to uniformly orient the fibers it is extremely important in both systems that the little hooks or teeth of the card clothings have a uniform height. Card clothings of the above-described type with a sufficiently uniform height of the teeth or hooks are described in Swiss patent 644,900, Swiss patent 655,521, Swiss patent 659,832, and British 2,236,543. With the card clothings described in these publications the cover linings are formed as a plurality of parallel sawtooth-wire strips and the support structure extends as a single piece under the entire foot region of these sawtooth-wire strips.

Since the card clothings are subjected to a great deal of wear during use of the carding machine and thus have to be changed often, such a construction is disadvantageous with respect to the considerable amount of material needed for the support structure.

In order to overcome this disadvantage Swiss patent 654,341 proposes to solder or weld together individual sawtooth-wire strips at their foot regions and to mount the thus formed sawtooth-wire strip pack without use of a support structure directly on the covers of a carding machine.

The construction of such sawtooth-wire strip packs with an adequate uniformity of tooth height is very expensive to produce because it requires a number of very precisely executed welding operations. For this reason the use of card coverings such as described in Swiss patent 654,341 is very disadvantageous from a practical point of view.

According to a suggestion described in above-named Swiss 655,521 the sawtooth-wire strips forming the cover linings are each provided in their foot region with a recess and a card clothing is formed therefrom with a bar-like support guide extending through these recesses. Then the sawtooth-wire strips are held in position on the bar with the aid of latching parts. With such a construction producing the recesses in the foot region of the individual sawtooth-wire strips must be done with extreme precision in order to ensure a uniform tooth height of the finished card clothing. In addition the bar-like support must be fitted with great precision in the recesses in order to prevent a shifting of the sawtooth-wire strips on the support. For this reason the manufacture of card coverings according to this proposal entails very high production costs.

OBJECTS OF THE INVENTION

It is therefore an object of the present invention to provide an improved card clothing for a carding machine.

Another object is the provision of such an improved card clothing for a carding machine which overcomes the above-given disadvantages, that is which is of simple construction so that it can be made cheaply, and that is easy to mount on and take off the machine.

SUMMARY OF THE INVENTION

According to the instant invention a card clothing comprises a cover lining having an inwardly directed and longitudinally extending foot part, a multiplicity of hooks extending outward from the foot part, and a pair of ends. A pair of longitudinally spaced support elements wholly out of direct contact with each other is provided, one end of the cover lining being seated in one of the support elements and the other end of the cover lining being seated in the other support element. The support elements are formed to fit with support structure of the carding machine.

The invention is based on the recognition that with a support structure comprised of several parts the cover lining itself has a support function and as a result it is possible to make a card clothing with less material and in an inexpensive manner without the disadvantage of an irregular tooth or hook height of the card clothing. With an arrangement according to the invention the support function of the cover lining is achieved in that a connection of the individual elements of the arrangement carrying the lining is itself formed by this lining. In general this is a "self-supporting" arrangement.

According to the invention the cover lining may be formed by a cover strip carrying small hooks. However, in a preferred embodiment the cover lining is formed by a plurality of parallel sawtooth-wire strips. The wires are all of identical length and each wire end is free of sawteeth and fixed in the respective support element. Furthermore each support element is a bar formed with a groove extending transversely of the wires and in which the respective ends of the wires are seated. The upper portion of the rail groove is a ledge overreaching the respective wire ends and clamping the respective wire ends down against a surface of the bar. To maximize hold each wire end has a bump engaged by the respective support element. With such a construction securing the cover lining on the support arrangement is effected by a simple pressing operation so that the construction of such a card clothing is further simplified.

The support elements or bars according to the invention together form an inwardly open T-section recess. The machine has a complementary T-section ridge complementarily engageable in the recess. In this manner the card clothings can be installed simply by sliding them onto a complementary T-shaped projection formed on the cover. It is also possible according to the invention for the wires to be secured in place by gluing, screwing, or the like on the cover.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
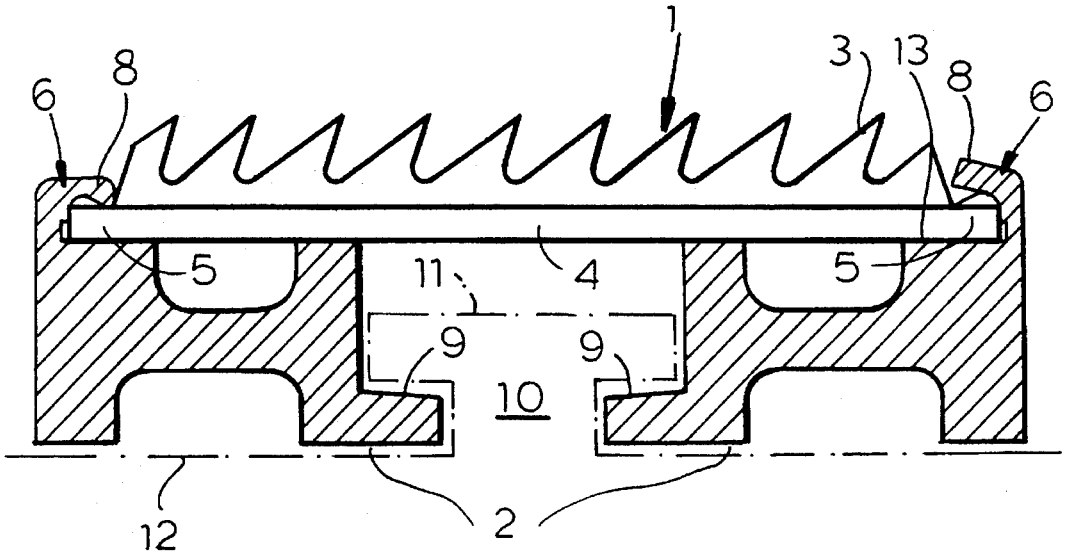
FIG. 1 is a large-scale cross section through the card clothing according to the invention.
Figure 2:
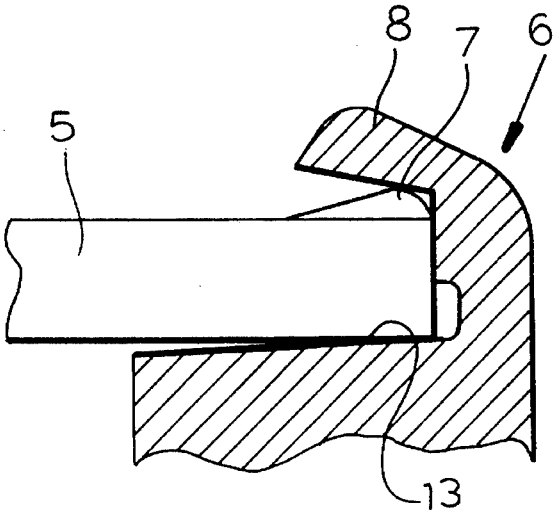
FIG. 2 is a larger-scale view of a detail of FIG. 1.

As seen in FIGS. 1 and 2 the card clothing is formed of a plurality of parallel sawtooth-wire strips 1 and two support elements 2 on which the sawtooth-wire strips 1 lie. The sawtooth-wire strips 1 each have an outwardly directed toothed part 3 and an inner foot part 4 and are provided on each of their ends with a toothless portion 5 formed only by the foot part 4. The support elements 2 each have a ledge 6 engaging over the toothless end portions 5 of the sawtooth wires 1. The toothless portions 5 of the sawtooth-wire strips 1 lie on a support surface 13 of the mounting bar 6 and are secured by means of portions 8 that clamp them down on the mounting bar surface 13.

As seen in FIG. 2 the toothless portions 5 of the sawtooth-wire strips are to this end each formed with a bump 7 which is overreached by the portions 8 of the mounting bars 6.

The extruded-aluminum support elements 6 have on their undersides inwardly directed flanges 9. These flanges 9 form between the support parts 2 and the sawtooth-wire strips a T-shaped recess 10. In this construction the card clothing can be installed by sliding onto a T-shaped projection 11 formed on the cover 12.

The present invention is not limited to the illustrated embodiment. For example the support elements can be formed also at least partly of a plastic. It is also possible to mount the card clothing according to the invention on the cover by means of threaded bores formed in the support elements of the card clothing.

I claim:

1. A card clothing comprising:

a cover lining having an inwardly directed and longitudinally extending foot part, a multiplicity of hooks extending outward from the foot part, and a pair of ends; and a pair of longitudinally spaced support elements wholly out of direct contact with each other, one end of the cover lining being fixed in one of the support elements and the other end of the cover lining being fixed in the other support element so that the card clothing is self supporting, the support elements together forming an inwardly open T-section recess adapted to fit with a complementary T-section support structure of the carding machine.

2. The card clothing defined in claim 1 wherein the cover lining is formed of a plurality of parallel sawtooth wire strips.

3. The card clothing defined in claim 2 wherein each wire end is free of sawteeth.

4. The card clothing defined in claim 3 wherein each support elements being formed with a groove extending transversely of the wires and in which the respective ends of the wires are fixed.

5. The card clothing defined in claim 4 wherein an upper portion of the groove is a ledge overreaching the respective wire ends and clamping the respective wire ends down against a surface of the bar.

6. The card clothing defined in claim 5 wherein each wire end has a bump engaged by the respective support element.

* * * * *